United States Patent [19]

Kennedy

[11] 3,941,343

[45] Mar. 2, 1976

[54] BRACKET SUPPORT ASSEMBLY

[76] Inventor: Ralph Kennedy, 461 Miller Road, South Windsor, Conn. 06074

[22] Filed: Aug. 30, 1974

[21] Appl. No.: 502,028

[52] U.S. Cl. ..... 248/223; 248/DIG. 3

[51] Int. Cl.[2] ..... F16M 13/00

[58] Field of Search .... 248/220.5, 223, 225, DIG. 3

[56] References Cited

UNITED STATES PATENTS

| | | | |
|---|---|---|---|
| 423,730 | 3/1890 | Charlton | 248/223 |
| 2,614,701 | 10/1952 | Mapson | 248/DIG. 3 |
| 3,191,777 | 6/1965 | Willits | 248/223 X |
| 3,241,799 | 3/1966 | Terlinde | 248/DIG. 3 |
| 3,250,235 | 5/1966 | McDonnell | 248/DIG. 3 |
| 3,322,287 | 5/1967 | Ragir | 248/DIG. 3 |
| 3,452,954 | 7/1969 | Lucietto et al. | 248/DIG. 3 |
| 3,477,677 | 11/1969 | Hindley | 248/DIG. 3 |

FOREIGN PATENTS OR APPLICATIONS

| | | | |
|---|---|---|---|
| 2,729 | 2/1906 | United Kingdom | 248/223 |

*Primary Examiner*—William H. Schultz

[57] ABSTRACT

A bracket support assembly is provided by the combination of a semiflexible web having holes therein for operatively receiving and supporting a portion of an article holding bracket and having spacing means extending away from one face of the semiflexible web, a semiflexible holding member disposed on the face of the web opposite the flange, the holding member having adjustable means for receiving and retaining a portion of the article holding bracket, and adjusting means disposed in the semiflexible web for adjusting the adjustable means of the holding member.

5 Claims, 6 Drawing Figures

BRACKET SUPPORT ASSEMBLY

BACKGROUND OF THE INVENTION

1. Subject of the Invention

This invention relates to a bracket support assembly for supporting article holding brackets, such as wire brackets, hooks and the like. More particularly, it relates to a supporting member for an article holding bracket, having adjustable means for regulating the force with which the article holding bracket is retained by the supporting member.

2. Description of the Prior Art

Many devices and methods have been devised for supporting article holding brackets on perforated or apertured panels. See, for example, U.S. Pat. Nos. 2,312,985; 3,037,733; 3,409,260; 3,429,539; 3,452,954; and 3,565,379. Many problems are associated with the known types of aperture board/brackets: Hooks, pegs and brackets have been devised which are supported loosely in holes in the board. In removing articles from them, they frequently fall off the aperture-board, necessitating their replacement before they can be used again. Many of the hooks, pegs and brackets fit only one thickness of aperture-board, rendering them unusable, or poorly fitting, on other boards. One of the most vexing problems encountered in the use of aperture-boards is that as articles are placed upon the brackets and removed therefrom, and as the brackets are moved from location to location on the aperture-board, the holes in the aperture-board, which operatively receive and support the brackets, become worn and are thereby enlarged to such a degree that they no longer support the bracket. The end result is, of course, that articles can no longer be placed upon the brackets because the brackets are incapable of supporting their weight without falling out of the holes in the board. I have devised a novel bracket support assembly which overcomes these undesirable failings of known aperture-board type brackets.

SUMMARY OF THE INVENTION

The object of the present invention is to provide an improved bracket support assembly for use on virtually any surface, including perforated or apertured boards and walls, panels and the like, which is adaptable to retain virtually any known type of bracket, hook or hanger.

In accordance with the present invention an improved bracket support assembly, which attains the above object and others, is provided by the combination of a semiflexible web having a hole or holes therein for operatively receiving and supporting a portion of an article holding bracket and having spacing means, such as, for example, a flange extending away from one face thereof; holding means, which may also be semiflexible, disposed on the face of the semiflexible web opposite the flange having adjustable means for operatively receiving and retaining a portion of the article holding bracket; and adjusting means disposed in said semiflexible web for adjusting the adjustable means of the holding member.

According to one embodiment of my invention, a bracket supporting member comprises a semiflexible web portion having a flange extending substantially perpendicular to and away from one face of the semiflexible web. The flange need not be continuous around the entire periphery of the web, but must be of sufficient extent to support the surface on which the bracket support assembly is to be affixed. The semiflexible web has holes therein for operatively receiving and supporting an article holding bracket, which may be a standard hardware item, and which forms no part of my invention per se. A semiflexible holding member is disposed on the opposite face of the semiflexible web from which said flange extends, and has adjustable slot means capable of operatively receiving and retaining a portion of the article holding bracket. Adjusting means are disposed in the semiflexible web in the form of a generally cylindrical member having a hole therethrough which is adapted to receive an adjustable fastener, such as a screw or bolt therein. The generally cylindrical member protrudes from the face of the semiflexible web a distance less than the distance the flange extends from the face of the semiflexible web. As the screw or bolt passing therethrough is tightened to the wall, panel, board, or whatever, the semiflexible web and the semiflexible holding member will close said slot means somewhat, thereby providing a tighter fit of the article holding bracket in the holding means.

DESCRIPTION OF THE PREFERRED EMBODIMENT

Figure 1:
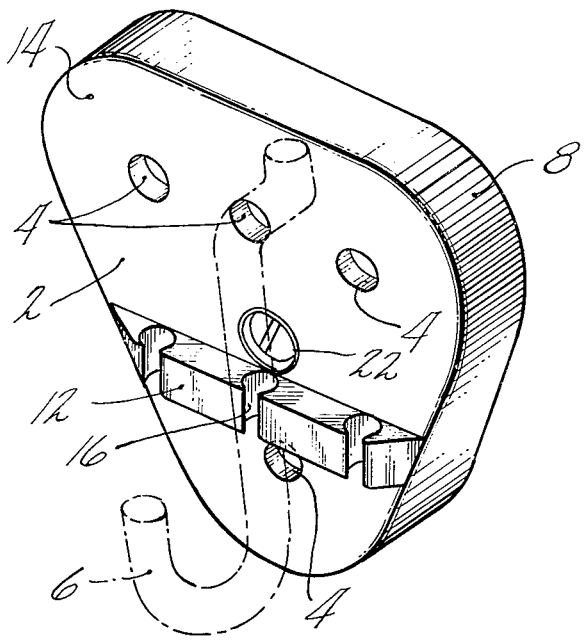
FIG. 1 is a perspective view of one embodiment of a bracket support assembly in accordance with the present invention.

Referring now to FIGS. 1 through 4, wherein like numerals refer to like elements, there is shown one embodiment of a bracket support assembly in accordance with the present invention. A semiflexible web 2 may have holes 4 for operatively receiving and supporting a portion or portions, of an article holding bracket 6 (shown in phantom lines). Spacing means, such as a flange 8 for example, extends away from a first face 10 of the web 2. Holding means 12, which may also be semiflexible, are disposed on the opposite, or second face 14 of the semiflexible web 2. The holding means 12 have adjustable means for operatively receiving and retaining a portion of the article holding bracket 6. The adjustable means may take the form of a slot 16 for receiving the bracket 6. Adjusting means 18 are disposed in the semiflexible web 2 for adjusting the adjustable means of the holding means 12, thereby adjusting the force with which the article holding bracket is retained in the holding means 12.

According to a preferred embodiment of my invention the semiflexible web 2 has a flange 8 extending substantially perpendicular to and away from the face 10 of the semiflexible web 2. It will be understood by those skilled in the art that the flange 8 need not extend completely around the periphery of the web 2, but only enough to hold the web 2 away from the wall surface 20 upon which the support bracket assembly is to be mounted.

Figure 6:
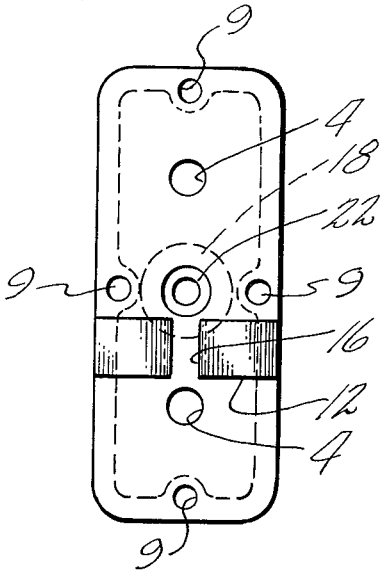
FIG. 6 is a front elevation view of another embodiment of a bracket support assembly in accordance with the present invention.
Figure 5:
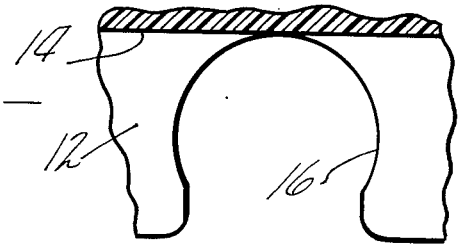
FIG. 5 is a partial sectional enlarged view of the slot for receiving and retaining the article holding bracket.
Figure 3:
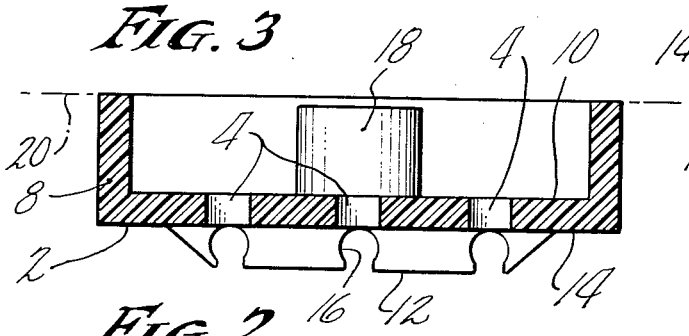
FIG. 3 is a sectional view taken along line 3—3 of FIG. 2.
Figure 2:
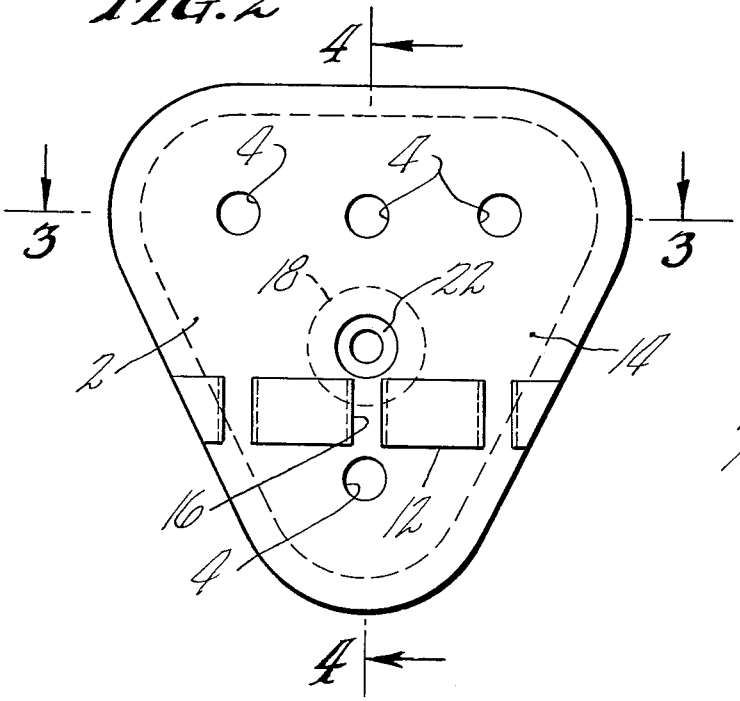
FIG. 2 is a front elevation view of the bracket support assembly of FIG. 1.
Figure 4:
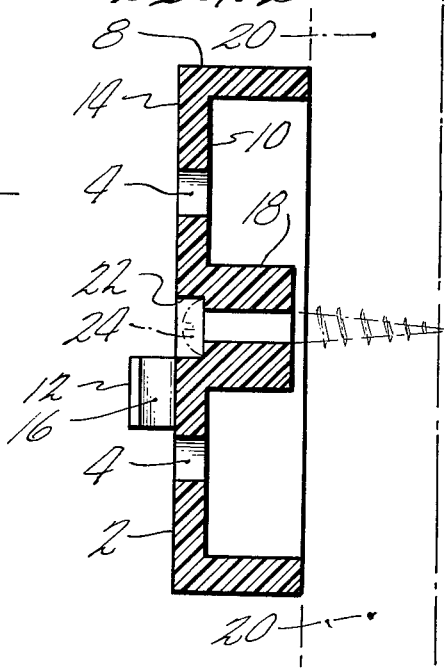
FIG. 4 is a sectional view taken along line 4—4 of FIG. 2.

In fact, the spacing means need not be a flange at all. It could be a series of spacing members such as, but not limited to, pins 9 around the periphery of the web 2 and extending substantially perpendicular to and away from the face 10 of the web 2 as shown in FIG. 6. The web 2 has holes 4 therein for receiving a portion or portions, of the article holding bracket 6. It will be understood by those skilled in the art that my bracket support assembly may be adapted for use with the many standard hardware brackets, which form no part of my invention per se, and that I have shown one type of bracket only by way of example. A holding member 12 is disposed on the opposite, or second, face 14 of the web 2. The holding member is preferably semiflexible also. The holding member 12 may have slot means 16 therein (seen best in FIG. 5) for receiving the bracket 6. The dimension of the opening of the slot means 16 is adjustable so that the force holding the bracket 6 therein is also adjustable. The force is adjustable as follows: adjusting means 18, which may take the form of a generally cylindrical member 18, has a hole 22 therethrough which is adapted to receive an adjustable fastener therein, such as a bolt or screw 24 (shown in FIG. 4). The fastener 24 passes through or into the wall surface, depending upon the type fastener and the type wall being penetrated. My bracket support assembly can be fastened to virtually any wall surface with screws, bolts, studs and stud anchors, bolts or screws with anchors, expansion bolts, toggle bolts, etc. The only requirements are that the fastener be adjustable; for example, any fastener with threads is satisfactory. The critical feature of this embodiment is that the cylindrical member 18 extends away from the face 10 of the web 2 a lesser distance than the spacing means, or flange 8, extends away from the face 10. The reason for this is that the head of the fastener is able to pull the web 2 towards the wall surface 20 as it is tightened; if the cylindrical member 18 were to meet the wall surface 20, while it still might be possible to tighten the fastener into the wall a greater amount, the web 2 would be unable to flex towards the wall surface 20. As the web 2 flexes towards the wall surface 20, the holding means 12 also bows and the slot 16 will close slightly. This closing will, of course, provide a smaller dimension across the slot opening and, hence, a tighter grasp of the article holding bracket 6.

There has thus been described a preferred embodiment of a bracket support assembly in accordance with the present invention. While one article holding bracket has been shown for example, it will be understood by those skilled in the art that the advantages of my invention can be realized with many types of brackets known in the art. Further, while I have shown a particular configuration of a bracket support assembly, it will be understood by those skilled in the art that the benefits of my invention may be derived in many configurations, and are not limited to the particular one shown in the preferred embodiment. Therefore, it should be understood by those skilled in the art that various changes and omissions in the form and detail thereof may be made therein without departing from the spirit and scope of the invention, which is to be limited only as set forth in the following claims.

What I claim as new and desire to secure by Letters Patent of the United States is:

1. A bracket support assembly for an article holding bracket for use on a wall surface, comprising:

a semiflexible web having a first face and second face and having means for receiving and supporting a portion of an article holding bracket;

spacing means disposed on said web extending away from said first face of said web for spacing said web from a wall surface;

holding means disposed on said second face of said web having adjustable means for operatively receiving and retaining a portion of an article holding bracket; and adjusting means disposed in said semiflexible web for adjusting the adjustable means of said holding means, said adjusting means comprising a boss disposed on said first face of said web, said boss extending a distance from said first face less than the distance said spacing means extends from said first face, whereby the force with which said holding means retains an article holding bracket may be adjusted.

2. A bracket support assembly as defined in claim 2, wherein said spacing means comprises a flange disposed on at least a portion of the periphery of said web.

3. A bracket support assembly as defined in claim 2, wherein said holding means comprises a member having a slot therein for receiving and holding a portion of an article holding bracket, said slot width being adjustable by said adjusting means.

4. A support bracket assembly as defined in claim 2, further comprising:

attaching means for attaching said bracket support assembly to a wall surface.

5. A support bracket assembly as defined in claim 2, wherein said spacing means comprises a plurality of spacing members disposed around the periphery of said web and substantially perpendicular to said first face of said web.

* * * * *

PO-1050
(5/85)

UNITED STATES PATENT OFFICE
CERTIFICATE OF CORRECTION

Patent No. 3,941,343 Dated March 2, 1976

Inventor(s) Ralph Kennedy

It is certified that error appears in the above-identified patent and that said Letters Patent are hereby corrected as shown below:

Col. 4, line 36, "claim 2" should read --claim 1--

Col. 4, line 36, "claim 2" should read --claim 1--

Col. 4, line 43, "claim 2" should read --claim 1--

Col. 4, line 47, "claim 2" should read --claim 1--

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*